United States Patent [19]

Fore

[11] Patent Number: 4,545,431

[45] Date of Patent: Oct. 8, 1985

[54] WIRELINE SET/TUBING RETRIEVE PACKER TYPE BRIDGE PLUG

[75] Inventor: William M. Fore, Duncan, Okla.

[73] Assignee: Halliburton Company, Duncan, Okla.

[21] Appl. No.: 613,663

[22] Filed: May 23, 1984

[51] Int. Cl.[4] ..... F21B 23/06

[52] U.S. Cl. ..... 166/183; 166/134; 166/123; 166/240

[58] Field of Search ..... 166/183, 134, 185, 123, 166/124, 381, 382, 387, 138, 240, 131

[56] References Cited

U.S. PATENT DOCUMENTS

| | | | |
|---|---|---|---|
| 3,223,169 | 12/1965 | Roark | 166/240 |
| 3,244,233 | 4/1963 | Villalon, Jr. | 166/123 |
| 3,386,764 | 6/1968 | Evans | 166/240 |
| 3,507,327 | 4/1970 | Chenoweth | 166/134 |
| 3,516,493 | 6/1970 | McGill | 166/134 |
| 3,584,684 | 6/1971 | Anderson et al. | 166/129 |
| 3,603,388 | 9/1971 | Current | 166/240 |
| 3,643,737 | 2/1972 | Current et al. | 166/216 |
| 3,749,166 | 7/1973 | Young | 166/123 |
| 3,749,167 | 7/1973 | Young | 166/217 |
| 4,078,606 | 3/1978 | Montgomery | 166/120 |
| 4,427,063 | 1/1984 | Skinner | 166/134 |
| 4,432,418 | 2/1984 | Mayland | 166/123 X |

*Primary Examiner*—Stephen J. Novosad
*Assistant Examiner*—Thuy M. Bui
*Attorney, Agent, or Firm*—James R. Duzan; Thomas R. Weaver

[57] ABSTRACT

A packer type bridge plug for use in wells which may be set upon a wireline and retrieved upon a tubing string.

20 Claims, 9 Drawing Figures

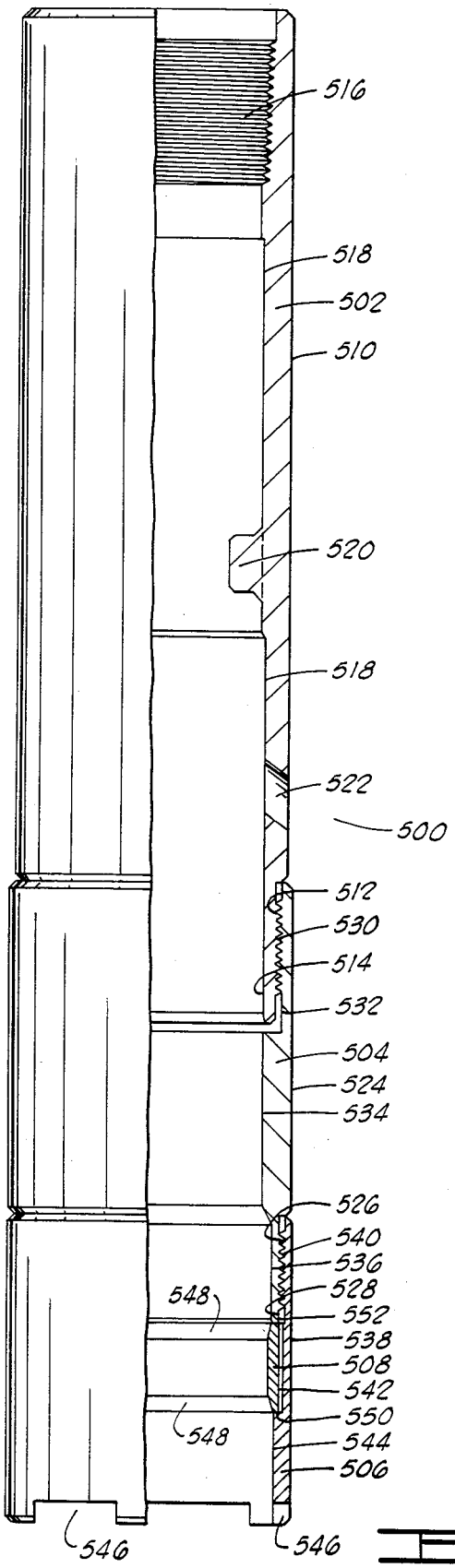
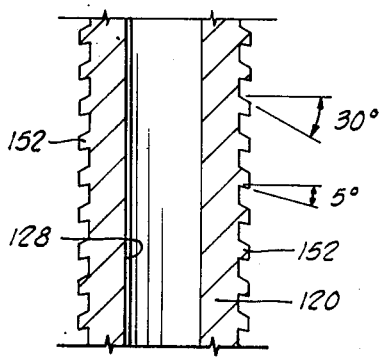
FIG. 4
FIG. 5

WIRELINE SET/TUBING RETRIEVE PACKER TYPE BRIDGE PLUG

BACKGROUND OF THE INVENTION

This invention relates to a bridge plug for use in wells. More specifically, this invention relates to a packer type bridge plug which may be set upon a wireline and retrieved upon a tubing string for use in wells.

In oil and gas wells it is desirable to have a bridge plug which will withstand high differential fluid pressures thereacross, can be set using a wireline and can be easily retrieved from the well.

Such a bridge plug is particularly desirable in wells where multiple formations are to be isolated for completion, testing and/or stimulation.

Some typical prior art retrievable packers and bridge plugs are disclosed in U.S. Pat. Nos. 3,244,233; 3,507,327; 3,584,684; 3,749,166; 4,078,606; and 4,427,063.

STATEMENT OF THE INVENTION

The present invention is directed to a packer type bridge plug which will hold differential fluid pressure from either direction and may be set upon a wireline while being easily retrieved upon a tubing string. The packer type bridge plug of the present invention comprises a J-slot mandrel, release valve sleeve, upper mandrel, center mandrel, cap, packer elements, packer element spacer, packer mandrel case, packer mandrel, ratchet blocks, J-slot case, upper wedge member, upper slips, lower slips, slip retainer, lower wedge member, lower mandrel, and bottom coupling. Also shown are the bridge plug setting sleeve, adapter, tension stud, and the bridge plug retrieving tool for use in retrieving the bridge plug from the casing in the well bore.

BRIEF DESCRIPTION OF THE DRAWINGS

FIG. 4 is a view of a portion of the ratchet thread on the center mandrel of the present invention.

FIG. 5 is a view of the retrieving tool used to retrieve the present invention from a well.

DESCRIPTION OF THE INVENTION

Figure 1A:
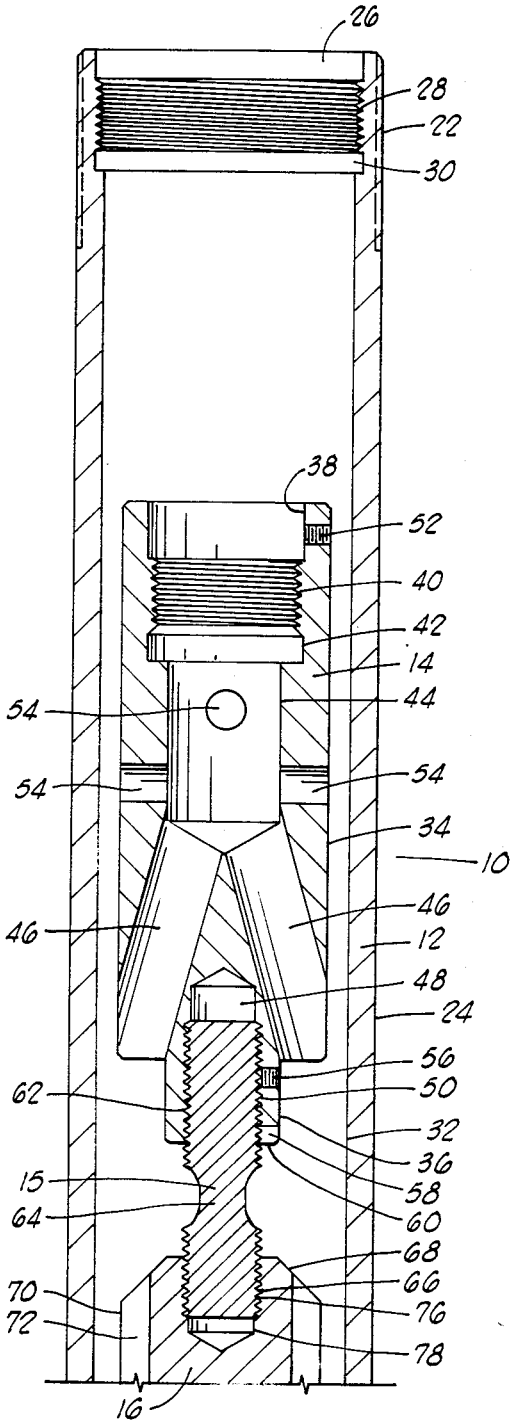
FIGS. 1A through 1E are cross-sectional views of the present invention.

Referring to FIG. 1A, a portion of the bridge plug 10 of the present invention is shown. Shown are a portion of the setting sleeve 12, adapter 14, tension stud 15, and a portion of the retrieving J-slot mandrel 16.

The setting sleeve 12 comprises an elongated annular cylindrical member having, on the exterior thereof, a plurality of wrenching flats 22 in exterior surface 24 and, on the interior thereof, first annular recess 26, threaded bore 28, second annular recess 30 and cylindrical bore 32.

The adapter 14 comprises a cylindrical member having, on the exterior thereof, first cylindrical exterior surface 34 and second cylindrical exterior surface 36 and, on the interior thereof, first annular recess 38, first threaded bore 40, second annular recess 42, first cylindrical blind bore 44, a plurality of longitudinal cylindrical bores 46 which allow fluid communication between bore 44 and the exterior of the adapter 14, second cylindrical blind bore 48 and second threaded bore 50. The adapter 14 further includes first threaded aperture 52, a plurality of apertures 54 which allow fluid communication between bore 44 and the exterior of the adapter 14, second threaded aperture 56, and annular recess 58 in the end 60 of the adapter 14.

The tension stud 15 comprises a cylindrical member having a first threaded end 62 which releasably threadedly engages second threaded bore 50 of adapter 14, a reduced diameter portion 64 and a second threaded end 66.

The release valve sleeve 18 comprises an elongated cylindrical annular member having, on the exterior thereof, cylindrical surface 82, on the interior thereof, bore 84, on one end, a plurality of longitudinal recesses or grooves 86, an annular rib 88 thereon and at least one threaded aperture 90 therethrough.

The portion of the J-slot mandrel 16 shown comprises a cylindrical member having, on the exterior thereof, frusto-conical annular surface 68 and first cylindrical surface 70 having, in turn, a plurality of J-shaped recesses 72 therein and blind bore 78 on one end thereof.

Figure 1B:
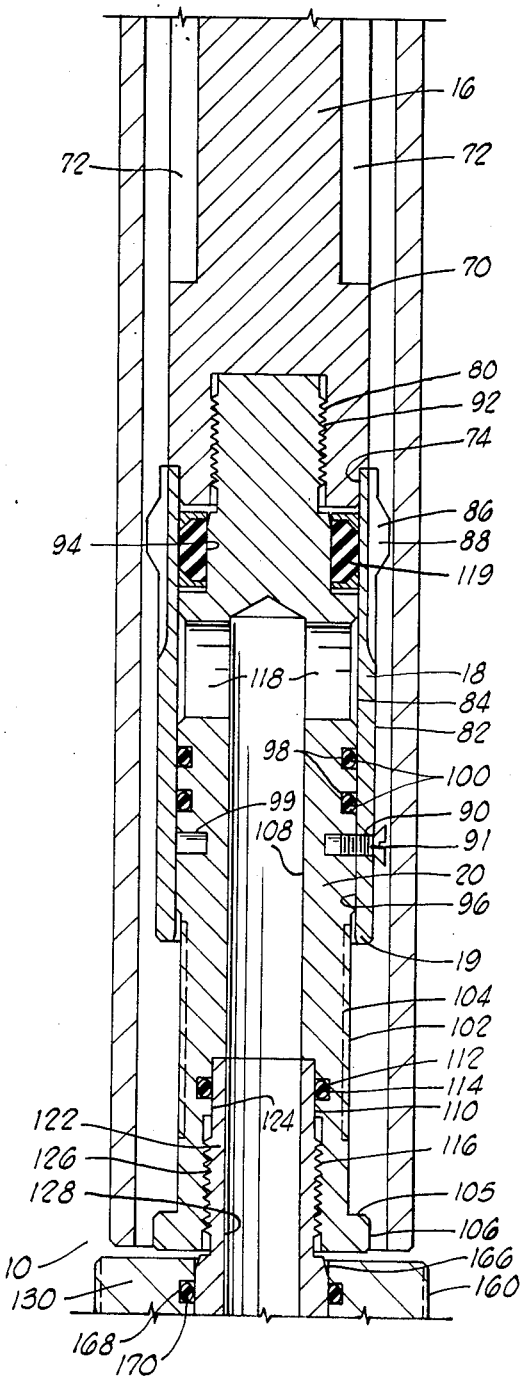

Referring to FIG. 1B, a further portion of the bridge plug 10 of the present invention is shown. Shown is the remaining portion of retrieving J-slot mandrel 16, release valve sleeve 18, upper mandrel 20, a portion of center mandrel 120 and a portion of cap 130

The remaining portion of the retrieving J-slot mandrel 16 comprises an elongated cylindrical member having, on the exterior thereof, first cylindrical surface 70 having, in turn, a plurality of J-shaped recesses 72 therein, and second cylindrical surface 74 and, on the interior thereof, first threaded bore 76 which releasably, threadedly engages second threaded end 66 of tension stud 15, blind bore 78 and second threaded bore 80.

The upper mandrel 20 comprises an elongated cylindrical member having, on the exterior thereof, threaded surface 92, first cylindrical surface 94, second cylindrical surface 96 having, in turn, a plurality of first annular recesses 98 therein containing annular elastomeric seals 100 therein which slidingly, sealingly engage bore 84 of release valve sleeve 18 and second annular recess 99, third cylindrical surface 102 having, in turn, a plurality of longitudinal recesses 104 therein, and fourth cylindrical surface 106 and, on the interior thereof, blind bore 108, first bore 110 having, in turn, annular recess 112 therein containing annular elastomeric seal 114 therein and threaded bore 116. The upper mandrel 20 further includes a plurality of apertures 118 which allow fluid communication between blind bore 108 and the exterior of mandrel 20. Installed on first cylindrical surface 94 of upper mandrel 20 is elastomeric member 119 which resiliently biases and sealingly engages the interior bore 84 of the end having annular recesses 86 therein of release valve sleeve 18 outwardly when sleeve 18 is retained in a first position on upper mandrel 20 by shear pin 91 extending through aperture 90 in sleeve 18 into annular recess 99 of upper mandrel 20.

The release valve sleeve 18 is releasably retained on release valve body 20 by a plurality of threaded shear pins 91 having a portion thereof threadedly engaging aperture 90 in sleeve 18 and having a portion thereof extending into annular recess 99 in release valve body 20.

Further shown in FIG. 1B is the upper end 122 of center mandrel 120. The upper end 122 of center mandrel 120 comprises a circular annular member having, on the exterior thereof, first cylindrical surface 124 which slidingly, sealingly engages seal 114 in first bore 110 of upper mandrel 20 and first threaded surface 126 which threadedly, releasably engages threaded bore 116 of upper mandrel 20 and, on the interior thereof, bore 128.

The portion of the cap 130 shown comprises an annular cylindrical member having, on the exterior thereof, first cylindrical surface 160 having, in turn, a plurality of wrenching flats 162 therein and, on the interior thereof, first bore 166 having, in turn, a plurality of annular recesses 168 therein containing annular elastomeric seals 170 therein which slidingly, sealingly engage second cylindrical surface 142 of center mandrel 120.

Figure 1C:
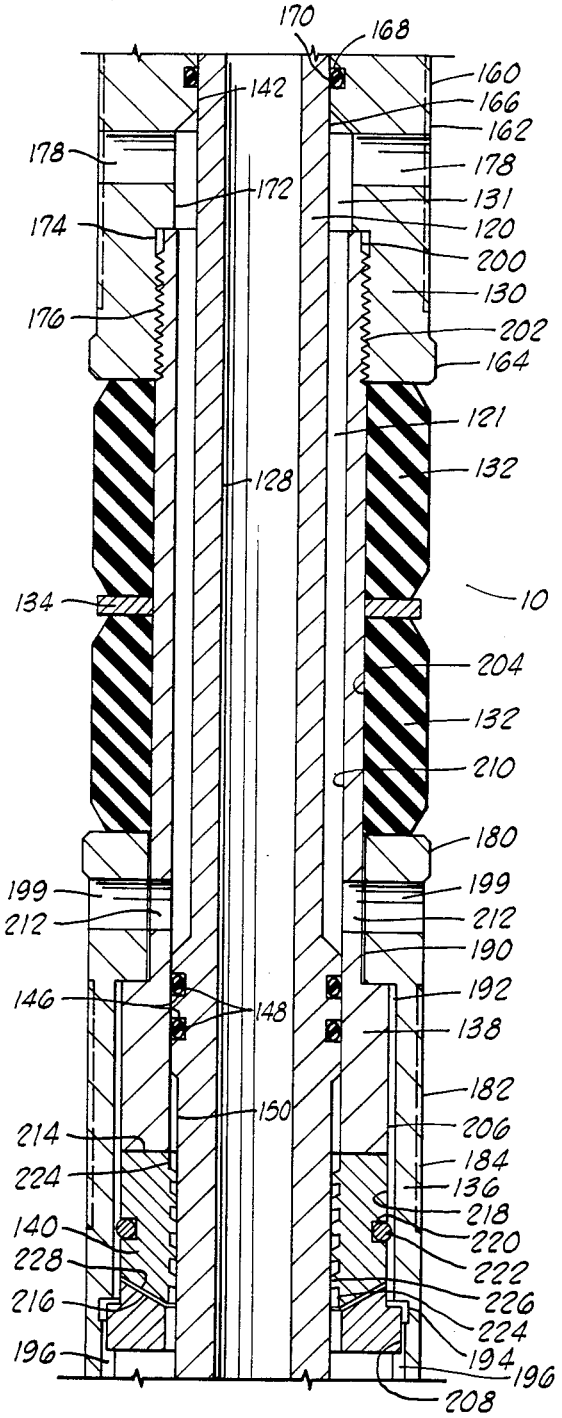

Referring to FIG. 1C, another portion of the bridge plug 10 of the present invention is shown.

Shown are a portion of the center mandrel 120, the remaining portion of cap 130, packer elements 132, packer element spacer 134, a portion of packer mandrel case 136, packer mandrel 138, and ratchet blocks 140.

The portion of the center mandrel 120 shown in FIG. 1C comprises an elongated cylindrical annular member having, on the exterior thereof, second cylindrical surface, third cylindrical surface 144 having, in turn, a plurality of annular recesses 146 therein containing annular elastomeric seal means 148 therein, fourth cylindrical surface 150, and ratchet thread portion 152 and, on the interior thereof, bore 128.

The remaining portion of cap 130 comprises a cylindrical annular member having, on the exterior thereof, first cylindrical surface 160 having, in turn, a plurality of wrenching flats 162 therein and second cylindrical surface 164 and, on the interior thereof, first bore 166 having, in turn, a plurality of annular recesses 168 therein containing annular elastomeric seals 170 therein which slidingly, sealingly engage second cylindrical surface 142 of center mandrel 120, second bore 172, third bore 174 and threaded bore 176. The cap 130 further includes a plurality of apertures 178 which allow fluid communication between the exterior of the cap 130 and second bore 172 on the interior thereof.

Each packer element 132 comprises an annular cylindrical elastomeric member having a bore therethrough.

The packer element spacer 134 comprises an annular cylindrical member having a bore therethrough.

The portion of the packer mandrel case 136 comprises an elongated annular cylindrical member having, on the exterior thereof, first cylindrical surface 180, second cylindrical surface 182 having, in turn, a plurality of wrenching flats 184 therein and, on the interior thereof, first bore 190, second bore 192, third bore 194 and a plurality of longitudinal recesses 196 which extend from third bore 194 to the end 198 of packer mandrel case 136. The packer mandrel case 136 further includes a plurality of apertures 199 therein to allow fluid communication between the exterior thereof and the interior thereof.

The packer mandrel 138 comprises an elongated cylindrical annular member having, on the exterior thereof, first cylindrical surface 200, threaded surface 202 which threadedly, releasably engages threaded bore 176 of cap 130, second cylindrical surface 204, third cylindrical surface 206, and fourth cylindrical surface 208 and, on the interior thereof, bore 210. The packer mandrel 138 further includes a plurality of apertures 212 which allow fluid communication between the exterior of the packer mandrel 138 and the interior thereof and a plurality of slot type apertures 214 which are of generally rectangular shape having an angular end 216 such that the rectangular shape of the aperture 214 on the interior of the mandrel 138 is larger than the rectangular shape of the aperture 214 on the exterior of the mandrel 138.

Each ratchet block 140 comprises rectangular shaped member having, on the exterior thereof, outer surface 218 having, in turn, rectangular recess 220 therein containing annular resilient annular garter spring 222 therein, and, on the interior thereof, arcuate smooth surface 224 and arcuate right hand lead threaded surface 226 which is complementary to right hand lead ratchet thread surface 152 on the center mandrel 120. Each ratchet block 140 further includes tapered end surface 228 which is complementary to end surface 216 in slot 214 of packer mandrel 138.

Figure 1D:
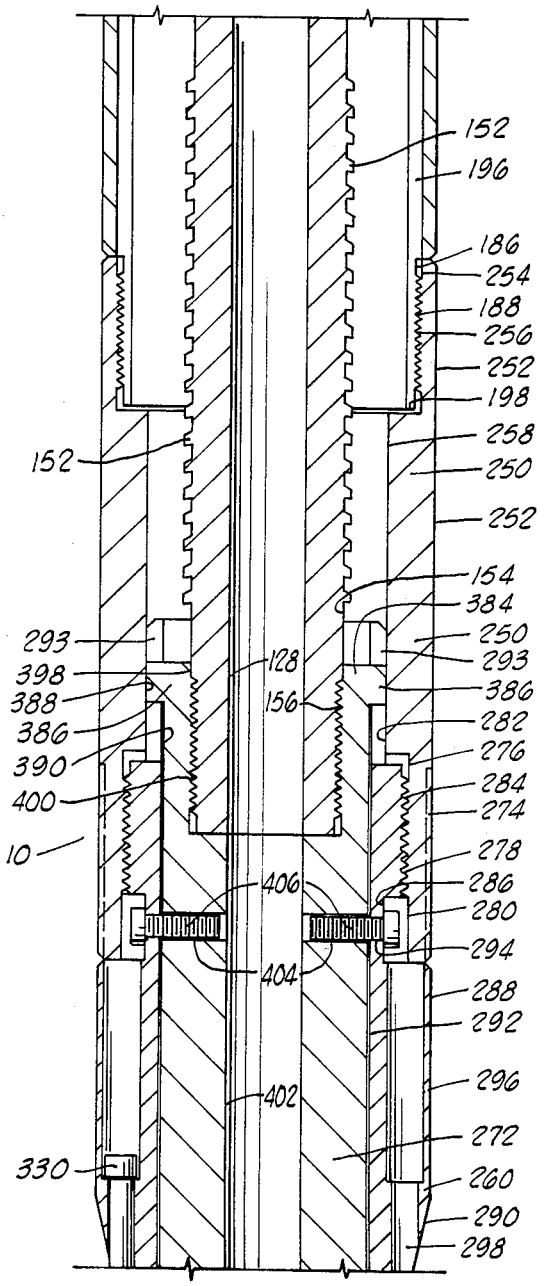

Referring to FIG. 1D, another portion of the bridge plug 10 of the present invention is shown.

Shown is the remaining portion of packer mandrel case 136, the J-slot case 250, a portion of upper wedge member 260, and a portion of lower mandrel 272.

The portion of center mandrel 120 shown comprises an elongated cylindrical annular member having, on the exterior thereof, right hand lead ratchet thread 152, fifth cylindrical surface 154 and second threaded portion 156.

The remaining portion of packer mandrel case 136 comprises an elongated annular cylindrical member having, on the exterior thereof, third cylindrical surface 186 and threaded surface 188 and, on the interior thereof, a plurality of longitudinal recesses 196 which extend from third bore 194 to the end 198 of packer mandrel case 136.

The J-slot case 250 shown comprises an elongated cylindrical annular member having, on the exterior thereof cylindrical surface 252 having, in turn, a plurality of wrenching flats 274 therein and on the interior thereof, first bore 254, first threaded bore 256, second bore 258, third bore 276, second threaded bore 278 and fourth bore 280.

The portion of the upper wedge member 260 shown comprises an elongated cylindrical annular member having, on the exterior thereof, first cylindrical surface 282, threaded surface 284 which threadedly, releasably engages second threaded bore of J-slot case 250, second cylindrical surface 286, third cylindrical surface 288 and frusto-conical surface 290 which tapers inwardly towards the center of member 260 to a wedged surface and, on the interior thereof, bore 292. The upper wedge member 260 further includes a plurality of J-slots 293 in one end thereof, a plurality of shear pin apertures 294 and a plurality of first longitudinal bores 296 which extend from second cylindrical surface 286 longitudinally in member 260 and second longitudinal bore 298 which communicate with bores 296 and are of smaller diameter terminating in frusto-conical surface 290.

The portion of the lower mandrel 272 comprises an elongated cylindrical annular member having, on one end 384 thereof, a plurality of lugs 386 which slidingly mate with J-slots 293 in upper wedge member 260, on the exterior thereof, first cylindrical surface 388 and second cylindrical surface 390 and, on the interior thereof, first bore 398, threaded bore 400 which threadedly, releasably engages second threaded portion 156 of the center mandrel 120 and second bore 402. The bottom mandrel 272 further includes a plurality of apertures 404 therein.

Figure 1E:
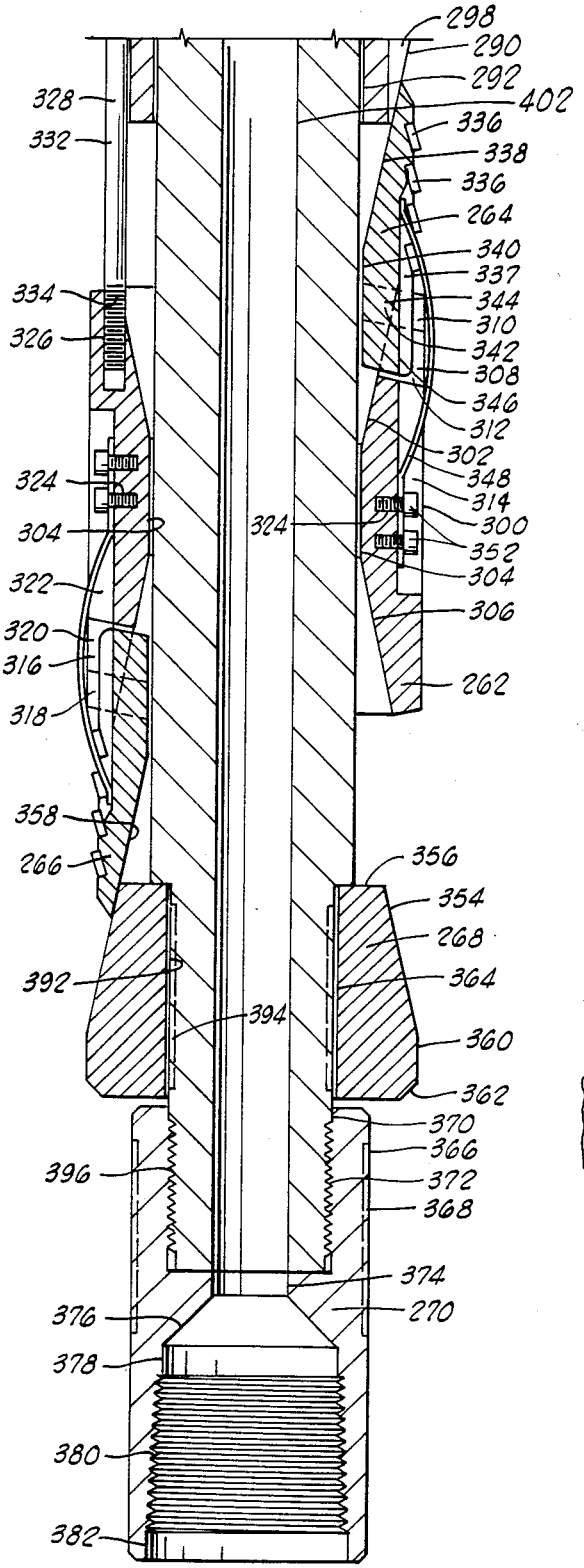

Referring to FIG. 1E, the remaining portion of the bridge plug 10 of the present invention is shown.

Shown are the remaining portion of upper wedge member 260, slip retainer 262, upper slips 264, lower slips 266, lower wedge member 268, bottom coupling 270 and remaining portion of lower mandrel 272.

The remaining portion of the upper wedge member 260 comprises a cylindrical annular member having, on the exterior thereof, frusto-conical surface 290, on the interior thereof, bore 292 and therethrough, a portion of second longitudinal bores 298.

The slip retainer 262 comprises a cylindrical annular member having, on the exterior thereof, cylindrical surface 300 and, on the interior thereof, first frusto-conical surface 302 which is complementary to frusto-conical surface 290 of upper wedge member 260, bore 304 and second frusto-conical surface 306. The slip retainer 262 further includes a first plurality of T-shaped recesses 308 in one end thereof having a stem portion 310 and a cross bar portion 312, a plurality of first longitudinal recesses 314 which extend through a portion of the first T-shaped recesses 308, a second plurality of T-shaped recesses 316 in the other end of the retainer 262 having a stem portion 318 and a cross bar portion 320, a plurality of second longitudinal recesses 322 which extend through a portion of the second T-shaped recesses 316, a plurality of threaded apertures 324, (not shown) an aperture extending from surface 30 to bore 304 which receives a shear pin (not shown) that has a portion thereof extending into annular recess 391 in lower mandrel 272 to releasably retain slip retainer 262 with respect to lower mandrel 272, and a plurality of threaded longitudinal bores 326 in one end of the slip retainer 262.

The slip retainer 262 is slidably, releasably secured to upper wedge member 260 by means of a plurality of elongated threaded fasteners 328, each having the head 330 thereof slidably retained in longitudinal bore 296 of wedge member 260, the stem 332 thereof slidably retained within a longitudinal bore 298 of wedge member 260 and the threaded portion 334 threadedly, releasably retained within a threaded longitudinal bore 326 of slip retainer 262.

Each upper slip 264 comprises an elongated, generally rectangular shaped member having on the exterior or top thereof, a plurality of teeth 336 and longitudinal recess 337, on the interior or bottom thereof, frusto-conical surface 338 which is complementary to frusto-conical surface 290 of upper wedge member 260 and arcuate or flat surface 340 and on one end thereof, T-shaped head 342 having stem portion 344 and cross bar portion 346 which is complementary to the T-shaped recess 308 in slip retainer 262.

Each lower slip 266 is identical in construction to each upper slip 264.

To resiliently bias each slip 264 or 266 inwardly in engagement with upper wedge member 260 or lower wedge member 268 a resilient spring member 348 is used. Each resilient spring member 348 has an end 350 resiliently engaging either the slip 264 or 266 in the longitudinal slot 337 therein while the other end of spring member 348 is releasably secured to slip retainer 262 by threaded fasteners 35 threadedly releasably engaging threaded apertures 324 in the slip retainer 262.

The lower wedge member 268 comprises a cylindrical annular member having, on the exterior thereof, frusto-conical surface 354 which tapers outwardly towards the exterior of member 268 from end 356 to form a wedge surface which is complementary to frusto-conical surface 358 on lower slips 266, cylindrical surface 360 and annular chamfered surface 362 and, on the interior thereof, bore 364.

The bottom coupling 270 comprises an elongated cylindrical annular member having, on the exterior thereof, cylindrical surface 366 having, in turn, wrenching flats 368 therein and on the interior thereof, first bore 370, first threaded bore 372, second bore 374, frusto-conical bore 376, third bore 378, second threaded bore 380 and fourth bore 382.

The remaining portion of lower mandrel 272 comprises an elongated cylindrical annular member having, on the exterior thereof, second cylindrical surface 390, annular recess 391, third cylindrical surface 392 having, in turn, wrenching flats 394 therein, and threaded surface 396 which threadedly releasably engages first threaded bore 372 of bottom coupling 270 and, on the interior thereof, second bore 402. The bottom mandrel 272 further includes a plurality of apertures 404 therein.

To releasably secure upper wedge member 260 to bottom mandrel 272 in a first position therein a plurality of shear pins 406 are installed in apertures 294 in wedge member 260 and apertures 404 in mandrel 272 being retained by fourth bore 280 of J-slot case 250 when case 250 is assembled with wedge member 260.

Figure 2:
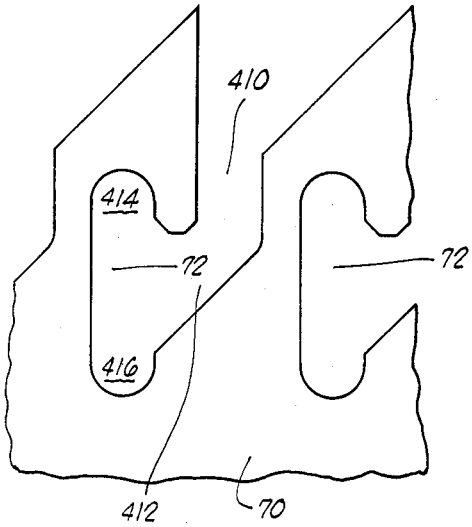
FIG. 2 is an unwrapped view of a portion of the J-slot configuration of the J-slot mandrel of the present invention which is used to retrieve the bridge plug.

Referring to FIG. 2, the J-shaped recesses 72 in the retrieving J-slot mandrel 16 are shown. Each J-shaped recess 72 is formed having entry portion 410, ramp portion 412, upper portion 414 and lower portion 416.

Figure 3:
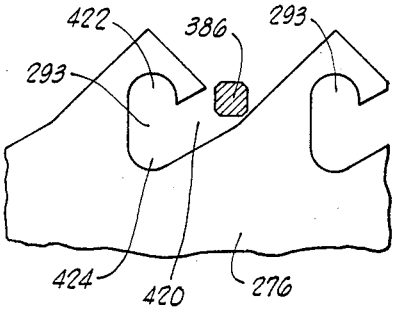
FIG. 3 is an unwrapped view of a portion of the J-slot configuration in one end of the upper wedge member of the present invention which is used to retract the slips during the retrieval of the bridge plug.

Referring to FIG. 3, the J-slot 293 in upper wedge member 260 is shown. Each J-slot 293 is formed having an entry portion 420, upper portion 422 and lower portion 424.

Referring to FIG. 4, a portion of the ratchet thread portion 152 on center mandrel 120 is shown. The ratchet thread may be of any convenient pitch and diameter. A thread having a 30° angle with respect to the vertical plane of the leading face of the thread and a 5° angle with respect to the vertical plane of the trailing face of the thread is preferred. The arcuate threaded surface 226 of the ratchet blocks 140 are similarly formed.

Referring to FIG. 5, the retrieving tool 500 for the retrieval of the bridge plug 10 of the present invention is shown.

The retrieving tool 500 comprises an overshot member 502, upper ring spring holder 504, lower ring spring holder 506 and ring spring 508.

The overshot member 502 comprises an elongated cylindrical annular member having, on the exterior thereof, first cylindrical surface 510, threaded surface 512, and second cylindrical surface 514 and, on the interior thereof, threaded bore 516 and bore 518 having, in turn, a plurality of lugs 520 located thereon. The overshot member 502 further includes a plurality of apertures 522 to allow fluid communication from the exterior thereof to the interior thereof.

The upper ring spring holder 504 comprises an elongated cylindrical annular member having, on the exterior thereof, first cylindrical surface 524, threaded surface 526 and second cylindrical surface 528 and, on the interior thereof, threaded bore 530 which threadedly, releasably engages threaded surface 512 of overshot member 502, first bore 532, second bore 534 and third bore 536.

The lower ring spring holder 506 comprises an elongated cylindrical annular member having, on the exterior thereof, cylindrical surface 538 and, on the interior thereof, threaded bore 540, first bore 542 and second bore 544. The lower ring spring holder 506 further includes a plurality of recesses 546 in one end thereof.

The ring spring 508 comprises an annular ring spring having annular frusto-conical annular surfaces 548 therein. The ring spring 508 is retained within first bore 542 of lower ring spring holder 506 having one end thereof abutting annular shoulder 550 of holder 506 while the other end thereof abuts end 552 of upper ring spring holder 504 when the holder 504 is secured to holder 506.

OPERATION OF THE INVENTION

Referring to FIGS. 1A through 1C, to set the bridge plug 10 of the present invention a Baker Model "E-4" Wireline Pressure Setting Assembly as sold by the Baker Oil Tool Company, Houston, Texas is used. The Baker Model "E-4" setting assembly is connected to setting sleeve 12 and adapter 14.

When the Baker Model "E-4" setting assembly is actuated, the setting assembly causes relative motion between the setting sleeve 12 and adapter 14. Initially, upon actuation of the Baker Model "E-4" setting assembly, the setting assembly pulls upwardly on the adapter 14 relative to the setting sleeve 12. Upon shearing of shear pins 406 securing lower mandrel 272 to upper wedge member 260, the upward movement by the adapter 14 causes upper movement of the retrieving J-slot mandrel 16, release valve body 20, center mandrel 120, slip retainer 262, lower mandrel 272, lower wedge member 268 and bottom coupling 270. As the slip retainer 262 moves upwardly relative to the upper wedge member 260, the slips 264 are cammed or wedged outwardly by the upper wedge member 260 into engagement with the casing in the well bore since the slip retainer 262 is releasably retained to the lower mandrel 272 by shear pins (not shown) engaging annular recess 391 therein. When the upper slips 264 engage the casing in the well bore, further upward movement of the slip retainer with respect to the upper wedge member 262 is prevented. At this time, the shear pins retaining the slip retainer 262 to the lower mandrel 272 shear thereby allowing relative movement therebetween.

At this time, the upward movement of the lower mandrel 272 causes lower wedge member 268 to cam lower slips 266 into engagement with the casing in the well bore.

At this point when the upper 264 and lower 266 slips engage the casing in the well bore, the Baker Model "E-4" setting assembly causes downward movement of the setting sleeve 12, cap 130, packer elements 132, packer mandrel 138, and packer mandrel case 136, relative to the retrieving J-slot mandrel 16, release valve body 20, center mandrel 120, lower mandrel 272, upper wedge member 260, lower wedge member 268 and bottom coupling 270.

This downward movement of the setting sleeve 12, cap 130, packer elements 132, packer mandrel 138, and packer mandrel case 136 causes the packer elements 132 to be compressed into engagement with the casing in the well bore and the ratchet blocks 140 to engage ratchet threads 152 on the center mandrel 120.

As the packer elements 132 are compressed into engagement with the casing in the well bore, the stress in the tension stud 15 increases. When the tension in tension stud 15 increases beyond a predetermined level, the stud 15 shears or fractures in the reduced diameter portion 64 of the stud 15. When the stud 15 shears or fractures, the relative movement of the various members or parts of the bridge plug 10 ceases.

When the upper 264 and lower 266 slips and the packer elements 132 engage the casing in the well bore and the tension stud 15 has sheared or severed, the ratchet blocks 140 which are engaging the ratchet threads 152 on the center mandrel 120 prevent any relative movement which would allow the bridge plug 10 to unset or disengage the casing in the well bore of the cap 130, packer elements 132, packer mandrel case **136*k* J-slot case 250, and upper wedge member 260 with respect to the retrieving J-slot mandrel 16, release valve body 20, center mandrel 120, lower mandrel 272, lower wedge member 268 and bottom coupling 270**.

After the tension stud 15 has sheared or severed and the bridge plug 10 has been set in the casing in the well bore, the Baker Model "E-4" setting assembly having setting sleeve 12, adapter 14 and a portion of the tension stud 15 secured thereto are removed from the well bore.

It should be noted that while running the bridge plug 10 of the present invention into the casing in the well bore, fluid below the packer elements 132 may bypass therearound through the bridge plug 10 via apertures 199 in packer mandrel case 136, apertures 212 in packer mandrel 138 annular space 121 between center mandrel 120 and packer mandrel 138, annular space 131 between center mandrel 120 and cap 130, and apertures 178 in cap 130.

Alternately, if the slip retainer 262 is not releasably secured to lower mandrel 272 by shear pins the sequence of the setting of the bridge plug 10 of the present invention is as follows.

When the Baker Model "E-4" setting assembly is actuated, the setting assembly causes relative motion between the setting sleeve 12 and adapter 14. Initially, upon actuation of the Baker Model "E-4" setting assembly, the setting assembly pulls upwardly on the adapter 14 relative to the setting sleeve 12. Upon shearing of shear pins 406 securing lower mandrel 272 to upper wedge member 260, the upward movement by the adapter 14 causes upper movement of the retrieving J-slot mandrel 16, release valve body 20, center mandrel 120, lower mandrel 272, lower wedge member 268 and bottom coupling 270. As the lower wedge member 268 moves upwardly relative to the lower slips 266, the slips 266 are cammed or wedged outwardly by the lower wedge member 268 into engagement with the casing in the well bore.

When the lower slips 266 engage the casing in the well bore, further upward movement of the retrieving J-slot mandrel 16, release valve body 20, center mandrel 120, lower mandrel 272, lower wedge member 268 and bottom coupling 270 with respect to the setting sleeve 12, cap 130, packer mandrel 138, packer mandrel case 136, J-slot case 250, and upper wedge 260 is prevented.

At this point the Baker Model "E-4" setting assembly causes downward movement of the setting sleeve 12, cap 130, packer elements 132, packer mandrel 138, packer mandrel case 136, J-slot case 250 and upper wedge member 260 relative to the retrieving J-slot mandrel 16, release valve body 20, center mandrel 120, lower mandrel 272, lower wedge member 268 and bottom coupling 270.

The downward movement of the setting sleeve 12, cap 130, packer elements 132, packer mandrel 138, packer mandrel case 136, J-slot case 250 and upper wedge member 260 causes the upper slips 264 to be cammed or wedged outwardly into engagement with the casing in the well bore. When the upper slips 264 engage the casing in the well bore, the downward movement of the upper wedge member 260 ceases. Although the downward movement of the upper wedge member 260 and thereby J-slot case 250 and packer mandrel case 138 ceases, the downward movement of packer mandrel 138, packer elements 132, cap 130 and setting sleeve 12 continues causing packer elements 132 to be compressed into engagement with the casing in the well bore and the ratchet blocks 140 to engage ratchet threads 152 on the center mandrel 120.

As the packer elements 132 are compressed into engagement with the casing in the well bore, the stress in the tension stud 15 increases. When the tension in tension stud 15 increases beyond a predetermined level, the stud 15 shears or fractures in the reduced diameter portion 64 of the stud 15. When the stud 15 shears or fractures, the relative movement of the various members or parts of the bridge plug 10 ceases.

When the upper 264 and lower 266 slips and the packer elements 132 engage the casing in the well bore and the tension stud 15 has sheared or severed, the ratchet blocks 140 which are engaging the ratchet threads 152 on the center mandrel 120 prevent any relative movement which would allow the bridge plug 10 to unset or disengage the casing in the well bore of the cap 130, packer elements 132, packer mandrel case 136, J-slot case 250, and upper wedge member 260 with respect to the retrieving J-slot mandrel 16, release valve body 20, center mandrel 120, lower mandrel 272, lower wedge member 268 and bottom coupling 270.

After the tension stud 15 has sheared or severed and the bridge plug 10 has been set in the casing in the well bore, the Baker Model "E-4" setting assembly having setting sleeve 12, adapter 14 and a portion of the tension stud 15 secured thereto are removed from the well bore.

As before, it should be noted that while running the bridge plug 10 of the present invention into the casing in the well bore, fluid below the packer elements 132 may bypass therearound through the bridge plug 10 via apertures 199 in packer mandrel case 136, apertures 212 in packer mandrel 138 annular space 121 between center mandrel 120 and packer mandrel 138, annular space 131 between center mandrel 120 and cap 130, and apertures 178 in cap 130.

To retrieve the bridge plug 10 of the present invention the retrieving tool 500 (shown in FIG. 5) is connected to a tubing string and lowered into the casing in the well bore.

Since the setting sleeve 12 and adapter 14 are not present on the set bridge plug 10 of the present invention in the casing in the well bore, the end of the retrieving tool 500 passes over the top of the retrieving J-slot mandrel 16 with the lugs 520 of the tool 500 engaging entry portion 410 of the J-slot 72 in mandrel 16 until the ring spring 508 passes over and engages the upper surface of annular rib 88 of release valve sleeve 18.

When ring spring 508 engages annular rib 88 of release valve sleeve 18 threaded shear pins 91 retaining sleeve 18 in a first position on release valve body 20 are sheared or severed with the continued downward movement of the retrieving tool 500 causing the sleeve 18 to move downwardly until end 19 of sleeve 18 abuts shoulder 105 at body 20 at which time ring spring 508 expands slightly and passes over annular rib 88. Concurrently with this action, the plurality of lugs 520 in the retrieving tool 500 have moved through entry portion 410, ramp portion 412 and into lower portion 416 of J-slot 72 (see FIG. 2) in retrieving J-slot mandrel 16.

When the downward movement of the retrieving tool 500 over J-slot mandrel 16 and release valve body 20 is completed with the ring spring 508 of the resiliently engaging annular rib 88 of sleeve 18, the retrieving tool 500 and tubing string is rotated to the right a predetermined number of revolutions.

During this rotation, the packer mandrel 138 having ratchet blocks 140 therein engaging ratchet thread 152 on center mandrel 120 moves relative to the center mandrel 120 until the packer mandrel 138 no longer engages the ratchet thread 152 returning to the position shown in FIG. 1B.

Also, further during this rotation, if it is not already within J-slot 293 of upper wedge member 260, the lugs 386 on lower mandrel 272 move through ramp portion 420 into lower portion 424 of J-slots 293 of member 260 (see FIG. 3).

During rotation the relative movement between packer mandrel 138 and center mandrel 120, the mandrel 120 secured to lower mandrel 272 causes lower wedge member 268 to move downwardly thereby allowing lower slips 266 to disengage the casing in the well bore being biased inwardly by resilient spring members 348.

After completion of a predetermined amount of rotation of the tubing string having retrieving tool 500 connected thereto, the tubing string and retrieving tool 500 are moved upwardly in the casing in the well bore. This upward movement causes lugs 520 on retrieving tool 500 to engage upper portion 414 (see FIG. 2) of J-slots 72 in retrieving J-slot mandrel 16 and lugs 386 on lower mandrel 272 to engage upper portion 422 (see FIG. 3) of J-slot 293 in upper wedge member 260 thereby allowing cap 130 to move upwardly relative to the center mandrel 120 allowing packer elements to disengage the casing in the well bore and moving upper wedge member 260 upwardly relative to the upper slips 264 allowing the slips 264 to disengage the casing in the well bore being resiliently biased inwardly by resilient spring members 348.

At this point, continued upward movement of the tubing string and retrieving tool 500 allows the removal of the bridge plug 10 of the present invention from the casing in the well bore.

It should be noted that after release valve sleeve 18 is moved into engagement with shoulder 105 of release valve body 20 any fluid pressure differential across the bridge plug 10 may be equalized by fluid flowing through the bores of bottom coupling 270, lower mandrel 272, center mandrel 120, release valve body 20 through apertures 118 therein, and retrieving tool 500 through apertures 522 therein. Also, during retrieval fluid may bypass around packer elements 132 through apertures 178, annular cavity 131, annular cavity 121 and apertures 212 and 199.

It will be understood that the foregoing disclosure and description of the bridge plug of the present invention are illustrative and explanatory thereof, and various modifications and changes in size, shape and materials as well as details of the illustrated construction may be made without departing from the scope of the invention.

Illustrations of such modifications and changes in the bridge plug 10 of the present invention are integrating or combining the ratchet blocks 140 and packer mandrel 138 such that the packer mandrel has a plurality of interiorly threaded resilient collet fingers on one end thereof to engage ratchet thread 152 on center mandrel 120, or integrating or combining the packer mandrel case 136 and J-slot case 250 into an elongated packer mandrel case or integrating or combining the lower wedge member 268 and lower mandrel 272, re-arranging the order of the components of the bridge plug, etc.

Also, the bridge plug 10 of the present invention could be utilized as a packer by changing the release valve sleeve 18 to a different type actuated valve to permit the selective flow of fluids through the packer.

Having thus described my invention, I claim:

1. A retrievable well tool for use in well bores, said retrievable well tool comprising:

a mandrel having at least one shaped recess in one end thereof, a ratchet thread on a portion thereof, and a plurality of lugs on a portion of the exterior thereof;

a cap slidably disposed on the mandrel;

a packer mandrel having a portion thereof adapted to releasably engage the ratchet thread on the mandrel, the packer mandrel being disposed about the mandrel;

a packer element disposed about the packer mandrel, the packer element adapted to releasably, resiliently engage said well bore;

a packer mandrel case disposed about a portion of the packer mandrel and the mandrel;

an upper wedge member disposed about the mandrel and having a plurality of shaped recesses in one end thereof which releasably engage the plurality of lugs of the mandrel and a frusto-conical surface on a portion of the exterior thereof;

a lower wedge member disposed about the mandrel having a frusto-conical surface on a portion of the exterior thereof; and a slip retainer disposed about the mandrel having a plurality of slips retained thereon, some of which slips slidably engage the frusto-conical surface of the upper wedge member and some of which slips slidably engage the frusto-conical surface on the lower wedge member.

2. The well tool of claim 1 wherein the mandrel comprises:

a J-slot mandrel having at least one shaped recess therein, a bore through a portion thereof and at least one aperture therethrough intersecting the bore;

an upper mandrel connected to the J-slot mandrel;

a center mandrel connected to the upper mandrel having a ratchet thread on a portion thereof; and a lower mandrel connected to the center mandrel having at least one lug thereon.

3. The well tool of claim 1 further comprising:

a release sleeve valve releasably, slidably retained on the mandrel.

4. The well tool of claim 3 wherein the packer mandrel comprises:

an elongated annular member having at least one aperture therein and at least one ratchet block resiliently retained within the aperture adapted to releasably, threadedly engage the ratchet thread on the mandrel.

5. The well tool of claim 4 wherein the tool further comprises:

a J-slot case connected to the packer mandrel case and the upper wedge member.

6. The well tool of claim 5 further comprising:

a bottom coupling connected to one end of the center mandrel.

7. The well tool of claim 6 further comprising:

an adapter having a first bore through a portion thereof and a second bore through another portion thereof; and a tension stud having a portion thereof connected to the adapter and another portion connected to the J-slot mandrel.

8. The well tool of claim 8 wherein the setting sleeve comprises:

an elongated annular member.

9. The well tool of claim 7 further including:

at least one shear pin to releasably retain the mandrel and the upper wedge member in a first position with respect to each other.

10. The well tool of claim 7 further comprising:

a setting sleeve adapted for use when setting said well tool in said well bores.

11. The well tool of claim 10 comprising:

a retrieving tool adapted for use in retrieving said well tool from said well bores.

12. The well tool of claim 11 further comprising:

a bypass for bypassing fluids in said well bores around the packer elements when running or retrieving said well tool in said well bores.

13. The well tool of claim 12 wherein the packer mandrel case includes:

at least one longitudinal passageway in the interior thereof.

14. The well tool of claim 13 wherein the packer mandrel includes:

at least one lug thereon which slidably mates with the longitudinal passageway in the interior of the packer mandrel case.

15. The well tool of claim 11 wherein the retrieving tool comprises:

an elongated annular member having at least one lug therein adapted to releasably engage the shaped recess in the mandrel.

16. A retrievable bridge plug for use in well bores, said retrievable well tool comprising:

a mandrel having at least one shaped recess in one end thereof, a ratchet thread on a portion thereof, and a plurality of lugs on a portion of the exterior thereof;

a cap slidably disposed on the mandrel;

a packer mandrel having a portion thereof adapted to releasably engage the ratchet thread on the mandrel, the packer mandrel being disposed about the mandrel;

a packer element disposed about the packer mandrel, the packer element adapted to releasably, resiliently engage said well bore;

a packer mandrel case disposed about a portion of the packer mandrel and the mandrel;

an upper wedge member disposed about the mandrel and having a plurality of shaped recesses in one end thereof which releasably engage the plurality of lugs of the mandrel and a frusto-conical surface on a portion of the exterior thereof;

a lower wedge member disposed about the mandrel having a frusto-conical surface on a portion of the exterior thereof; and a slip retainer disposed about the mandrel having a plurality of slips retained thereon, some of which slips slidably engage the frusto-conical surface of the upper wedge member and some of which slips slidably engage the frusto-conical surface on the lower wedge member.

17. The retrievable bridge plug of claim 16 wherein the mandrel comprises:

a J-slot mandrel having at least one shaped recess therein, a bore through a portion thereof and at least one aperture therethrough intersecting the bore;

an upper mandrel connected to the J-slot mandrel;

a center mandrel connected to the upper mandrel having a ratchet thread on a portion thereof; and a lower mandrel connected to the center mandrel having at least one lug thereon.

18. The well tool of claim 16 further comprising:

a release sleeve valve releasably, slidably retained on the mandrel;

a J-slot case connected to the packer mandrel case and the upper wedge member;

a bottom coupling connected to one end of the center mandrel;

an adapter having a first bore through a portion thereof and a second bore through another portion thereof; and a tension stud having a portion thereof connected to the adapter and another portion connected to the J-slot mandrel.

19. The retrievable bridge plug of claim 18 further comprising:

a bypass for bypassing fluids in said well bores around the packer elements when running or retrieving said well tool in said well bores.

20. A retrievable bridge plug for use in well bores, said retrievable well tool comprising:

a mandrel having at least one shaped recess in one end thereof, a ratchet thread on a portion thereof, and a plurality of lugs on a portion of the exterior thereof;

a cap slidably disposed on the mandrel;

a packer mandrel having a portion thereof adapted to releasably engage the ratchet thread on the mandrel, the packer mandrel being disposed about the mandrel;

a packer element disposed about the packer mandrel, the packer element adapted to releasably, resiliently engage said well bore;

a packer mandrel case disposed about a portion of the packer mandrel and the mandrel;

an upper wedge member disposed about the mandrel and having a plurality of shaped recesses in one end thereof which releasably engage the plurality of lugs of the mandrel and a frusto-conical surface on a portion of the exterior thereof;

a lower wedge member disposed about the mandrel having a frusto-conical surface on a portion of the exterior thereof;

a slip retainer disposed about the mandrel having a plurality of slips retained thereon, some of which slips slidably engage the frusto-conical surface of the upper wedge member and some of which slips slidably engage the frusto-conical surface on the lower wedge member;

a release sleeve valve releasably, slidably retained on the mandrel;

a J-slot case connected to the packer mandrel case and the upper wedge member;

a bottom coupling connected to one end of the center mandrel;

an adapter having a first bore through a portion thereof;

a tension stud having a portion thereof connected to the adapter and another portion connected to the J-slot mandrel;

a bypass for bypassing fluids in said well bores around the packer elements when running or retrieving said well tool in said well bores.

* * * * *

UNITED STATES PATENT AND TRADEMARK OFFICE

CERTIFICATE OF CORRECTION

PATENT NO. : 4,545,431

DATED : October 8,1985

INVENTOR(S) : William M. Fore

It is certified that error appears in the above-identified patent and that said Letters Patent is hereby corrected as shown below:

Column 12, line 17, "8" should read -- 10 --.

Signed and Sealed this

*Fifth* Day of *August 1986*

[SEAL]

*Attest:*

DONALD J. QUIGG

*Attesting Officer*

*Commissioner of Patents and Trademarks*